US010030919B2

(12) United States Patent
Nakamura et al.

(10) Patent No.: US 10,030,919 B2
(45) Date of Patent: Jul. 24, 2018

(54) COOLING APPARATUS FOR SUPERCONDUCTOR

(71) Applicant: MAYEKAWA MFG. CO., LTD., Tokyo (JP)

(72) Inventors: Naoko Nakamura, Tokyo (JP); Masahiro Shimoda, Tokyo (JP); Shunsuke Komatsu, Tokyo (JP); Ryusuke Ono, Tokyo (JP); Hiroharu Yaguchi, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 372 days.

(21) Appl. No.: 15/067,176

(22) Filed: Mar. 11, 2016

(65) Prior Publication Data

US 2016/0265838 A1 Sep. 15, 2016

(30) Foreign Application Priority Data

Mar. 12, 2015 (JP) ..... 2015-048975

(51) Int. Cl.
*F25D 29/00* (2006.01)
*F28F 23/02* (2006.01)
(Continued)

(52) U.S. Cl.
CPC ..... *F28F 23/02* (2013.01); *F25B 25/005* (2013.01); *F25D 17/02* (2013.01); *F28F 27/00* (2013.01)

(58) Field of Classification Search
CPC ..... F28F 23/02; F28F 27/00; F25B 25/005; F25D 17/02; H01B 12/00; H01B 12/16
See application file for complete search history.

(56) References Cited

U.S. PATENT DOCUMENTS

2006/0065004 A1* 3/2006 Lee ..... F25B 25/005 62/333
2013/0333912 A1* 12/2013 Yamamoto ..... H02G 15/34 174/15.5

FOREIGN PATENT DOCUMENTS

EP 2980805 2/2016
JP 2011-54500 3/2011
(Continued)

*Primary Examiner* — Hoa C Nguyen
*Assistant Examiner* — Amol Patel
(74) *Attorney, Agent, or Firm* — JCIPRNET

(57) ABSTRACT

A low-cost and space-saving cooling apparatus for a superconductor that prevents a function of the superconductor being compromised when a refrigerator is faulty.

A cooling apparatus for a superconductor forms a circulation path in which a coolant, having been used for cooing the superconductor, is pumped by a circulation pump to a heat exchanger unit so that the coolant is cooled by a refrigerator, and the coolant is supplied to the superconductor. The cooling apparatus for a superconductor includes: a sub-cooling tank which is disposed on a downstream side of the superconductor and on an upstream side of the heat exchanger unit in the circulation path and which is configured to store a secondary coolant for cooling the coolant; a secondary heat exchanger unit which is disposed in the sub-cooling tank and which is configured to cool the coolant, having been used for cooling the superconductor, through heat exchange with the secondary coolant; a depressurizing unit configured to reduce pressure in the sub-cooling tank to cool the secondary coolant; a temperature detection unit for detecting temperature of the secondary coolant; a fault detection unit capable of detecting a fault state of the refrigerator; and a control unit configured to determine whether the refrigerator is faulty, based on information detected by the fault detection unit, and to control, upon determining that the refrigerator is faulty, an operation of the
(Continued)

depressurizing unit so that the temperature of the secondary coolant, detected by the temperature detection unit, becomes a predetermined temperature at which the secondary coolant is capable of cooling the superconductor through the coolant.

4 Claims, 4 Drawing Sheets

(51) Int. Cl.

| | |
|---|---|
| ***F25D 17/02*** | (2006.01) |
| ***F25B 25/00*** | (2006.01) |
| ***F28F 27/00*** | (2006.01) |

(56) References Cited

FOREIGN PATENT DOCUMENTS

| | | |
|---|---|---|
| JP | 2011-127824 | 6/2011 |
| JP | 2012-251667 | 12/2012 |
| JP | 2014-126283 | 7/2014 |
| JP | 2014-199744 | 10/2014 |
| JP | 2014-199745 | 10/2014 |
| WO | 2012/114507 | 8/2012 |

* cited by examiner

COOLING APPARATUS FOR SUPERCONDUCTOR

CROSS-REFERENCE TO RELATED APPLICATIONS

This application claims the priority benefit of Japan application serial no. 2015-48975, filed on Mar. 12, 2015. The entirety of the above-mentioned patent application is hereby incorporated by reference herein and made a part of this specification.

TECHNICAL FIELD

The present invention relates to a cooling apparatus for a superconductor for cooling the superconductor to an extremely low temperature.

BACKGROUND

A superconducting cable, which is one example of a superconductor, might lose its superconductive function and have its conductivity compromised due to a temperature rise caused by thermal load associated with the use and external heat intrusion. Thus, the superconducting cable, at the time of conducting electric power, needs to be constantly cooled to be maintained in an extremely low temperature state. One generally known method for cooling the superconducting cable employs circulative cooling using a sub-cooled coolant. This circulative cooling method using the sub-cooled coolant includes: cooling the coolant to be in a sub-cooled state with a refrigerator; transmitting the cooled coolant to the superconducting cable by a pump; and returning the coolant, having been used for cooling the superconducting cable, to the refrigerator.

However, the circulative cooling method using the sub-cooled coolant has the following risk. Specifically, when the refrigerator becomes faulty, the temperature of the sub-cooled coolant rises, and thus the temperature of the coolant for cooling the superconducting cable rises. As a result, the superconducting cable might lose the superconductive function and have its conductivity compromised. To overcome this risk, in one proposed method, a plurality of refrigerators are prepared. One of the refrigerators is operated in a normal state, and when this refrigerator becomes faulty, another one of the refrigerators is operated (see Japanese Patent Application Laid-open No. 2011-54500).

CITATION LIST

Patent Literature

Patent Document 1: Japanese Patent Application Laid-open No. 2011-54500

SUMMARY

Technical Problem

The cooling apparatus for a superconducting cable, described in Japanese Patent Application Laid-open No. 2011-54500, includes the plurality of refrigerators, and thus requires a high cost and a large installation space. Furthermore, switching to a non-faulty refrigerator involves a risk of a temporary temperature rise of the circulating suppercooled coolant during the several hours required for cooling the refrigerator. As a result, the superconducting cable might lose the superconductive function and have its conductivity compromised.

In view of the above circumstances, an object of at least one embodiment of the present invention is to provide a cooling apparatus for a superconductor that can achieve a low cost and a small installation space, and has no risk of compromising the function of the superconductor when a refrigerator becomes faulty.

Solution to Problem

A cooling apparatus for a superconductor according to at least one embodiment of the present invention is for cooling the superconductor with a circulation path formed by pumping a coolant, having been used for cooing the superconductor, by a circulation pump to a heat exchanger unit so that the coolant is cooled by a refrigerator, and then supplying the coolant to the superconductor and includes: a sub-cooling tank which is disposed on a downstream side of the superconductor and on an upstream side of the heat exchanger unit in the circulation path and which is configured to store a secondary coolant for cooling the coolant; a secondary heat exchanger unit which is disposed in the sub-cooling tank and which is configured to cool the coolant, having been used for cooling the superconductor, through heat exchange with the secondary coolant stored in the sub-cooling tank; a depressurizing unit configured to reduce pressure in the sub-cooling tank to cool the secondary coolant stored in the sub-cooling tank; a temperature detection unit for detecting temperature of the secondary coolant stored in the sub-cooling tank; a fault detection unit capable of detecting a fault state of the refrigerator; and a control unit configured to determine whether the refrigerator is faulty, based on information detected by the fault detection unit, and to control, upon determining that the refrigerator is faulty, an operation of the depressurizing unit so that the temperature of the secondary coolant, detected by the temperature detection unit, becomes a predetermined temperature at which the secondary coolant is capable of cooling the superconductor through the coolant.

In the cooling apparatus for a superconductor described above, the control unit determines whether the refrigerator is faulty based on the information detected by the defect detection unit. Upon determining that the refrigerator is faulty, the control unit controls the operation of the depressurizing unit so that the temperature of the secondary coolant, detected by the temperature detection unit, becomes the predetermined temperature at which the secondary coolant is capable of cooling the superconductor through the coolant. Thus, the secondary coolant in the sub-cooling tank is cooled, and a cooled coolant is obtained through heat exchange between the cooled secondary coolant and the coolant flowing in the circulation path, via the heat exchanger unit in the sub-cooling tank. Thus, the temperature rise of the superconductor can be prevented, whereby conductivity of the superconductor can be prevented from being compromised when the refrigerator is faulty. When the refrigerator is faulty, the coolant can be cooled only by using the sub-cooling tank, the secondary heat exchanger unit in the sub-cooling tank, and the depressurizing device. Thus, no extra refrigerator, including a compressor, a gas cooler, a regenerator, and an expander, needs to be prepared as a backup. Thus, the cooling apparatus achieving both a low cost and a small installation space can be obtained.

A cooling apparatus for a superconductor according to at least one embodiment of the present invention is for cooling the superconductor with a circulation path formed by pumping a coolant, having been used for cooing the superconductor for use in conduction of electric power, by a circulation pump to a heat exchanger unit so that the coolant is cooled by a refrigerator, and then supplying the coolant to the superconductor and includes: a sub-cooling tank which is disposed in the circulation path and which is configured to store a secondary coolant used for cooing the coolant; a secondary heat exchanger unit which is disposed in the sub-cooling tank and which is configured to cool the coolant, having been used for cooling the superconductor, through heat exchange with the secondary coolant stored in the sub-cooling tank; a depressurizing unit configured to reduce pressure in the sub-cooling tank to cool the secondary coolant stored in the sub-cooling tank; a temperature detection unit for detecting temperature of the secondary coolant stored in the sub-cooling tank; a fault detection unit capable of detecting a fault state of the refrigerator; and a control unit configured to determine whether the refrigerator is faulty, based on information detected by the fault detection unit, and to control, upon determining that the refrigerator is faulty, an operation of the depressurizing unit so that the temperature of the secondary coolant, detected by the temperature detection unit, becomes a predetermined temperature at which the secondary coolant is capable of cooling the superconductor through the coolant. The heat exchanger unit is disposed in the sub-cooling tank, and is configured to cool the secondary coolant, stored in the sub-cooling tank, through heat exchange with a refrigerator side coolant in the refrigerator. The secondary heat exchanger unit is configured to exchange heat between the cooled secondary coolant and the coolant flowing in the circulation path to cool the coolant.

In the cooling apparatus for a superconductor, when the refrigerator is not faulty and thus is in a normal state, the cooled secondary coolant is obtained through heat exchange between the secondary coolant, stored in the sub-cooling tank, and the refrigerator side coolant in the refrigerator via the heat exchanger unit in the sub-cooling tank. Then, the cooled coolant is obtained through heat exchange between the cooled secondary coolant and the coolant flowing in the circulation path, via the secondary heat exchanger unit in the sub-cooling tank. Thus, the temperature rise of the superconductor can be prevented.

Upon determining that the refrigerator is faulty based on the information detected by the defect detection unit, the control unit controls the operation of the depressurizing unit so that the temperature of the secondary coolant, detected by the temperature detection unit, becomes the predetermined temperature at which the secondary coolant is capable of cooling the superconductor through the coolant. Thus, when the depressurizing unit operates, the secondary coolant in the sub-cooling tank is cooled. The cooled coolant is obtained by heat exchange between the cooled secondary coolant and the coolant flowing in the circulation path, via the secondary heat exchanger unit in the sub-cooling tank, and is used for cooling the superconductor. Thus, the temperature rise of the superconductor can be prevented, and the conductivity of the superconductor can be prevented from being compromised when the refrigerator is faulty. When the freezer is faulty, the coolant can be cooled only by using the sub-cooling tank, the secondary heat exchanger unit in the sub-cooling tank, and the depressurizing device. Thus, no extra refrigerator, including a compressor, a gas cooler, a regenerator, and an expander, needs to be prepared as a backup. Thus, the cooling apparatus achieving both a low cost and a smaller installation space can be obtained.

In some embodiments, a supply tank for storing the secondary coolant is further provided. The supply tank is in communication with the depressurizing unit and the sub-cooling tank. The secondary coolant stored in the supply tank is cooled by the depressurizing unit and supplied to the sub-cooling tank.

In such a case, when the amount of the secondary coolant in the sub-cooling tank becomes small, the secondary coolant stored in the supply tank is cooled by the depressurizing unit, and then is supplied to the sub-cooling tank, to avoid the risk of degrading the cooling performance for cooling the coolant, through heat exchange between the secondary coolant and the coolant flowing in the circulation path, due to the reduction in the secondary coolant in the sub-cooling tank to a small amount. Thus, the superconductor can be prevented from losing the superconductivity to have its conductivity compromised when the refrigerator is faulty.

Advantageous Effects

In at least some embodiments of the present invention, a cooling apparatus for a superconductor can be provided that can achieve a low cost and a small installation space, and has no risk of compromising the function of the superconductor when a refrigerator becomes faulty.

DESCRIPTION OF THE PREFERRED EMBODIMENTS

Embodiments of a cooling apparatus for a superconductor according to the present invention are described below with reference to FIGS. 1 to 4. A superconducting cable is described as an example of the superconductor in the embodiments. Materials, shapes, relative relationships, and the like of components described in the embodiments are merely an example for the description, and do not limit the scope of the present invention.

[First Embodiment]

Figure 1:
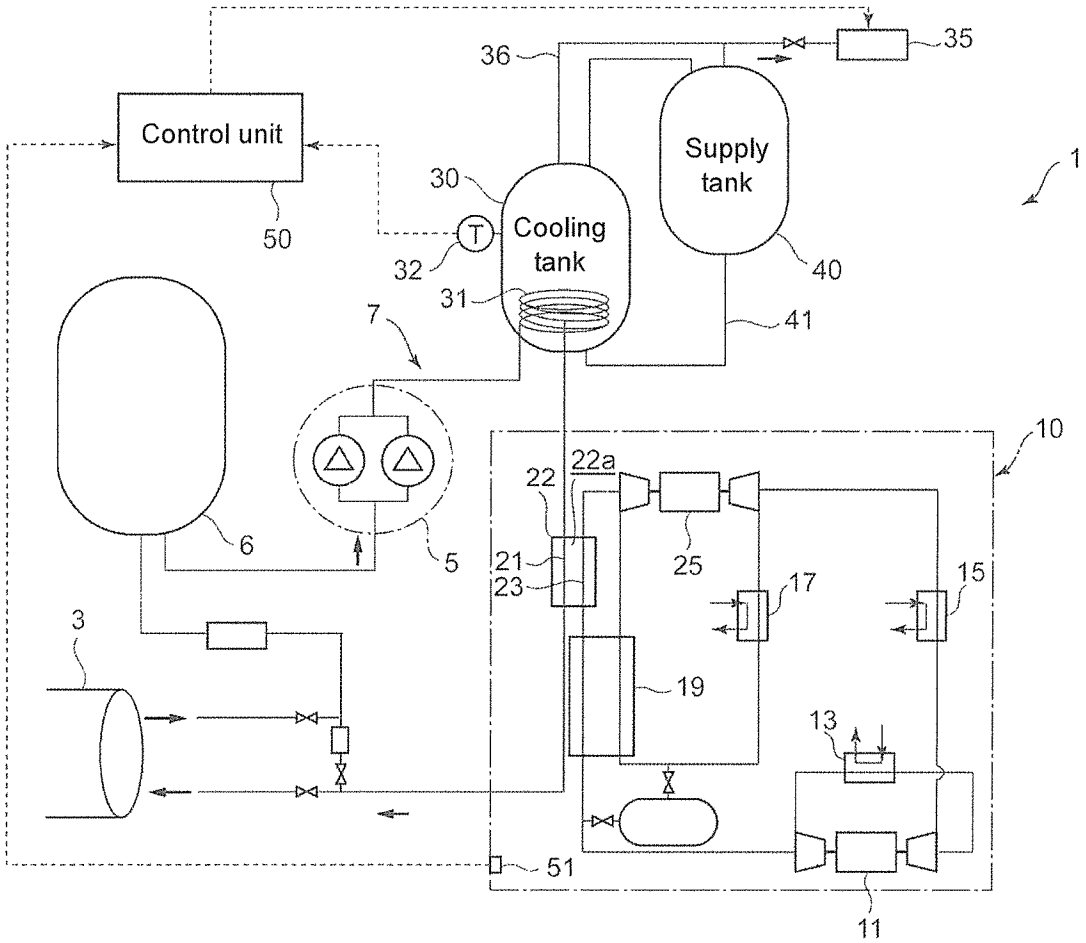
FIG. 1 is a diagram illustrating an overall schematic configuration of a cooling apparatus for a superconductor according to one embodiment of the present invention.
Figure 2:
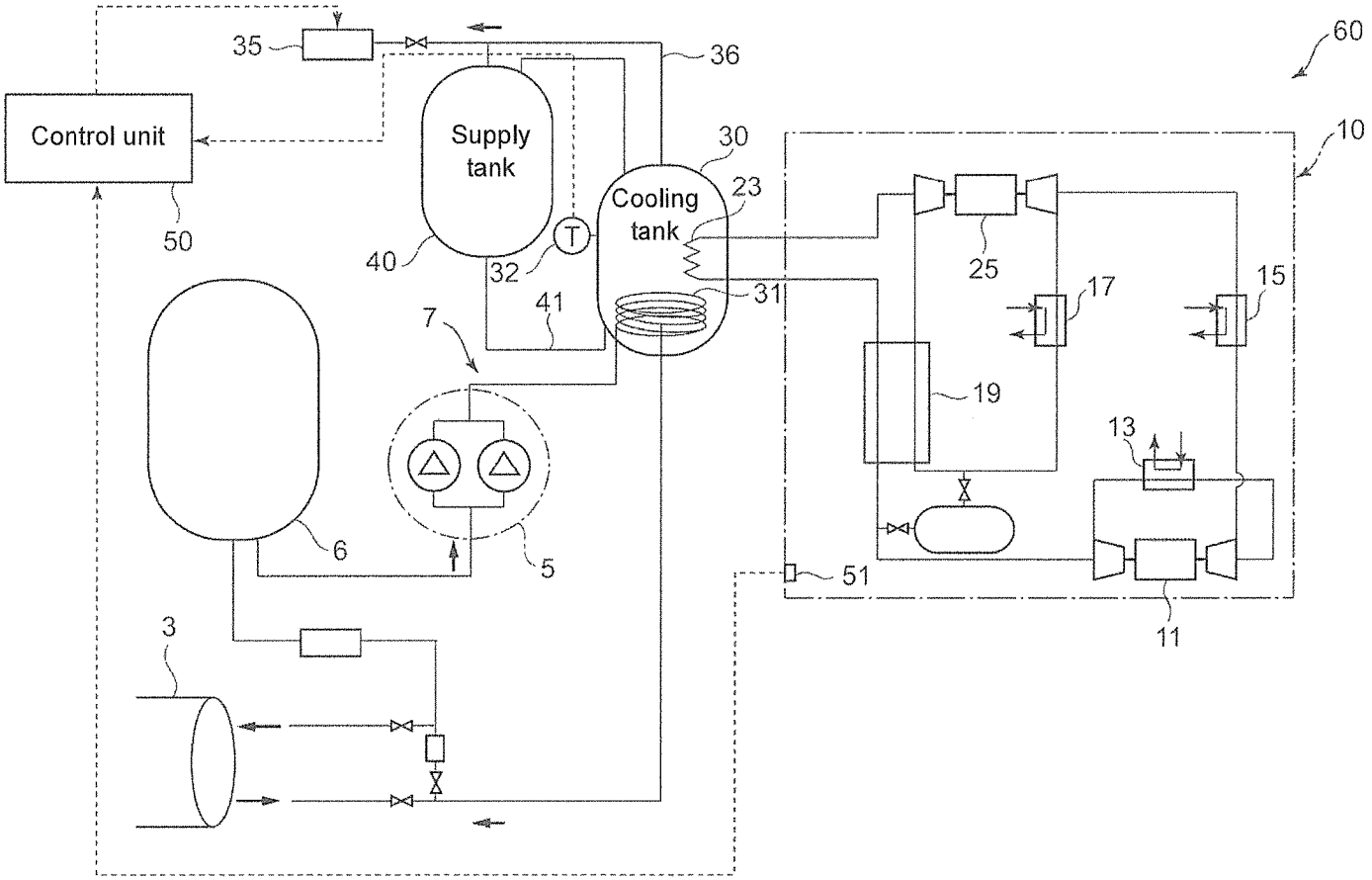
FIG. 2 is a diagram illustrating an overall schematic configuration of a cooling apparatus for a superconductor according to another embodiment of the present invention.

As illustrate in FIG. 1, a cooling apparatus 1 for a superconductor cools a superconducting cable 3 with a circulation path 7 formed by pumping a coolant, having been used for cooling the superconducting cable 3, by a circulation pump 5 to a Brayton heat exchanger unit 21 of a refrigerator 10, so that the coolant is cooled, and then supplying the coolant to the superconducting cable 3 again. The superconducting cable 3 is formed of a high temperature superconductor, and is cooled by a coolant (liquid nitrogen) flowing in the circulation path 7. Although not elaborated in FIG. 1, a flow path, for the coolant flowing in the circulation path 7 (hereinafter, referred to as "circulating coolant"), generally has a vacuum insulated circumference, except for a portion around the Brayton heat exchanger unit 21, so that external heat can be prevented from entering.

A reservoir tank 6, for storing the circulating coolant flowing in the circulation path 7 while being pressurized to a predetermined value, is disposed on an upstream side of and is connected to the circulation pump 5 provided to the circulation path 7. In the reservoir tank 6, the coolant is stored while being pressurized to a predetermined value by an unillustrated pressuring device, so that change in the volume of the circulating coolant, caused by the temperature change, is offset, to make the circulating coolant less likely to vaporize due to a temperature rise. Thus, high applicability can be achieved even when the amount of heat, produced in the superconducting cable 3, changes over time.

A sub-cooling tank 30 that stores a secondary coolant is disposed on a downstream side of and is connected to the circulation pump 5 provided to the circulation path 7. A secondary heat exchanger unit 31, for performing heat exchange between the circulating coolant and the secondary coolant, is provided in the sub-cooling tank 30. The circulating coolant flowing in the circulation path 7 is pumped to the secondary heat exchanger unit 31 in the sub-cooling tank 30 by the circulation pump 5. The secondary coolant (liquid nitrogen) stored in the sub-cooling tank 30 is used for cooling the circulating coolant when the refrigerator 10 is faulty and cannot cool the circulating coolant. Thus, the circulating coolant is cooled even when the refrigerator 10 is faulty, so that conductivity can be prevented from being compromised due to the loss of the superconductivity of the superconducting cable 3. A temperature sensor 32 is provided in the sub-cooling tank 30 for detecting the temperature of the secondary coolant stored in the sub-cooling tank 30. The temperature sensor 32 is electrically connected to a control unit 50 described later.

The secondary heat exchanger unit 31 is made of a material with a high thermal conductivity, or has the other like configuration to have high thermal conductivity. Thus, the amount of heat, received from the circulating coolant flowing in the secondary heat exchanger unit 31, can be exchanged with that of the external. For example, the secondary heat exchanger unit 31 is a flow path formed of a pipe, made of a material having a high thermal conductivity such as metal, bent into a spiral shape. In such a case, the secondary heat exchanger unit 31 may have an appropriate sophisticated shape with a large surface area. The circulating coolant, flowing in the secondary heat exchanger unit 31, is cooled through heat exchange with the secondary coolant (liquid nitrogen) stored in the sub-cooling tank 31.

The circulating coolant cooled in the secondary heat exchanger unit 31 is supplied again to the superconducting cable 3. Thus, the superconducting cable 3 is supplied with a low-temperature circulating coolant to be constantly maintained in an extremely low temperature state.

A depressurizing device 35 for cooling the secondary coolant is connected to the sub-cooling tank 30 through a suction path 36. The depressurizing device 35 is a vacuum pump, for example. When the depressurizing device 35 is driven, the sub-cooling tank 30 is depressurized, and thus the secondary coolant is vaporized. In this process, the remaining secondary coolant is separated from latent heat of vaporization and thus can be cooled.

A supply tank 40 is connected to the sub-cooling tank 30 via a supply path 41. The supply tank 40 stores the secondary coolant (liquid nitrogen) to be supplied when the amount of the secondary coolant in the sub-cooling tank 30 becomes small. The secondary coolant is supplied to the supply tank 40 from a tanker (not illustrated). For supplying the secondary coolant from the tanker to the supply tank 40, an operation of achieving the atmospheric pressure in the supply tank 40 is required. Furthermore, when the liquid nitrogen supplied from the tanker, which has a temperature at or higher than its boiling point, is supplied to the sub-cooling tank 30 through the supply tank 40, the temperature of the secondary coolant (liquid nitrogen) in the sub-cooling tank 30 rises, and thus the temperature of the circulating coolant flowing in the secondary heat exchanger unit 31 rises. To prevent this temperature rise, the depressurizing device 35 (vacuum pump) is connected to the supply tank 40, whereby the secondary coolant supplied from the tanker is cooled in the supply tank 40, depressurized by the depressurizing device 35, to be supplied to the sub-cooling tank 30. Thus, the secondary coolant in the sub-cooling tank 30 can be maintained at a constant temperature to be in a cooling state.

The Brayton heat exchanger unit 21 is provided on a downstream side of the sub-cooling tank 30 provided to the circulation path 7. The Brayton heat exchanger unit 21 is disposed in a heat exchanger unit 22 including a cooling space 22*a* filled with (including) liquefied gas. In the present embodiment, the liquefied gas, filled in the cooling space 22*a*, is liquid nitrogen, as in the case of the circulating coolant flowing in the circulation path 7. The liquefied gas is more preferably slush nitrogen obtained by mixing liquid nitrogen and solid nitrogen.

A Brayton cycle heat exchanger unit 23 serving as a part of the refrigerator 10 is disposed in the heat exchanger unit 22. The Brayton cycle heat exchanger unit 23 is disposed in the cooling space 22*a*, filled with the liquefied gas, in the heat exchanger unit 22, together with the Brayton heat exchanger unit 21 described above.

The refrigerator 10 is a Brayton cycle refrigerator, and includes a turbo-compressor 11, heat exchangers 13, 15, 17, and 19, a turbo-expander 25, and the Brayton cycle heat exchanger unit 23. Gas, with a lower liquefying temperature than the liquefied gas filled in the cooling space 22*a*, circulates in the refrigerator 10. In the present embodiment, neon gas is used as the gas filled in the cooling space 22*a*. Examples of the gas, circulating in the refrigerator 10, may include helium gas. With such gas circulating in the refrigerator 10, a temperature sufficiently lower than that of the liquefied gas filled in the cooling space 22*a* is achieved in the Brayton cycle heat exchanger unit 23. Thus, the cooling temperature of the liquefied gas, filled in the cooling space 22*a*, can be controlled by controlling an operation state of the refrigerator 10.

The gas (coolant) flowing in the Brayton cycle heat exchanger unit 23 receives the amount of heat produced by the superconducting cable 3 while passing through the superconducting cable 3, and further receives the amount of heat while being pumped by the circulation pump 5, to have a high temperature. In the Brayton cycle heat exchanger unit 23, the coolant with the amount of heat thus accumulated is cooled through the heat exchange with the liquefied gas filled in the cooling space 22*a*. As described above, the temperature of the liquefied gas can be controlled by controlling the operation state of the refrigerator 10 as described above.

The control unit 50 is electrically connected to the refrigerator 10 and the depressurizing device 35, and controls operations of the refrigerator 10 and the depressurizing device 35 based on information acquired from a refrigerator fault sensor 51 described later and a detection value from the temperature sensor 32. The refrigerator fault sensor 51 is a sensor for detecting abnormality of the turbo-compressor 11 and the turbo-expander 25 in the refrigerator 10, for example. Upon determining that the refrigerator 10 is faulty based on the information acquired from the refrigerator fault sensor 51, the control unit 50 stops the refrigerator 10, and controls the operation of the depressurizing device 35 so that the temperature of the secondary coolant, detected by the temperature sensor 32, becomes a predetermined temperature at which the secondary coolant is capable of cooling the superconducting cable 3 through the circulating coolant.

The refrigerator fault sensor 51 may be a sensor for detecting the temperature of the circulating coolant output from an outlet of the Brayton heat exchanger unit 21. In this case, when the temperature of the circulating coolant, detected by the refrigerator fault sensor 51, exceeds a predetermined threshold, the control unit 50 stops the refrigerator 10 and drives the depressurizing device 35.

Next, an operation of the cooling apparatus 1 for a superconductor will be described. The circulating coolant (liquid nitrogen) having been used for cooling the superconducting cable 3 flows out from the superconducting cable 3, flows into the reservoir tank 6 provided to the circulation path 7, and then flows into the circulation pump 5. Then, the circulating coolant is pumped by the circulation pump 5 to flow into the secondary heat exchanger unit 31 in the sub-cooling tank 30. Because the depressurizing device 35 is in a non-operating state in the sub-cooling tank 30, the secondary coolant in the sub-cooling tank 30 is in a non-cooled state. Thus, the cooled secondary coolant is obtained through the heat exchange between the circulating coolant flowing in the secondary heat exchanger unit 31 in the sub-cooling tank 30 and the secondary coolant. The circulating coolant that has flown in the secondary heat exchanger unit 31 flows in the circulation path 7, is cooled by the Brayton heat exchanger unit 21, and returns to and cools the superconducting cable 3.

Figure 3:
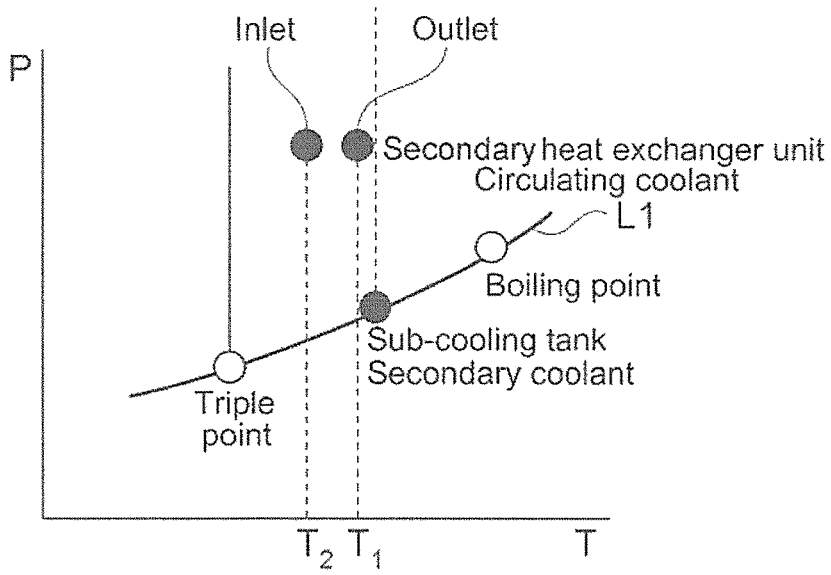
FIG. 3 is a graph illustrating an example of how pressure and temperature of a circulating coolant and a secondary coolant change while a refrigerator is operating.

Here, how the pressure and the temperature of the secondary coolant (liquid nitrogen) in the sub-cooling tank 30 and of the circulating coolant (liquid nitrogen) circulating in the circulation path 7 change while the refrigerator 10 is operating is described with reference to FIG. 3. In FIG. 3, the vertical axis represents the pressure and the horizontal axis represents the temperature. The temperature and the pressure of the secondary coolant in the sub-cooling tank 30 are changed, along a saturated vapor pressure curve L1, by the circulating coolant (liquid nitrogen) circulating in the circulation path 7. The circulating coolant is pressurized by the pressurizing device of the reservoir tank 6 to be in a sub cool state. The depressurizing device 35 is in the non-operating state, and thus a temperature T1 of the circulating coolant, discharged from the outlet of the secondary heat exchanger unit 31, is slightly higher than a temperature T2 of the circulating coolant, flowing into an inlet of the secondary heat exchanger unit 31, as a result of absorbing heat of the secondary coolant in the sub-cooling tank 30.

On the other hand, as illustrated in FIG. 1, upon determining that the refrigerator 10 is faulty based on the information acquired from the refrigerator fault sensor 51, while the circulating coolant is circulating in the superconducting cable 3, the control unit 50 stops the refrigerator 10 and controls the operation of the depressurizing device 35 so that the temperature of the secondary coolant, detected by the temperature sensor 32, becomes the predetermined temperature at which the secondary coolant is capable of cooling the superconducting cable 3 through the circulating coolant. With the decompression in the sub-cooling tank 30 thus achieved, the secondary coolant in the sub-cooling tank 30 is cooled. Thus, the cooling of the circulating coolant is achieved through the heat exchange between the secondary coolant in the sub-cooling tank 30 and the circulating coolant flowing in the secondary heat exchanger unit 31. The circulating coolant thus cooled returns to and cools the superconducting cable 3.

Figure 4:
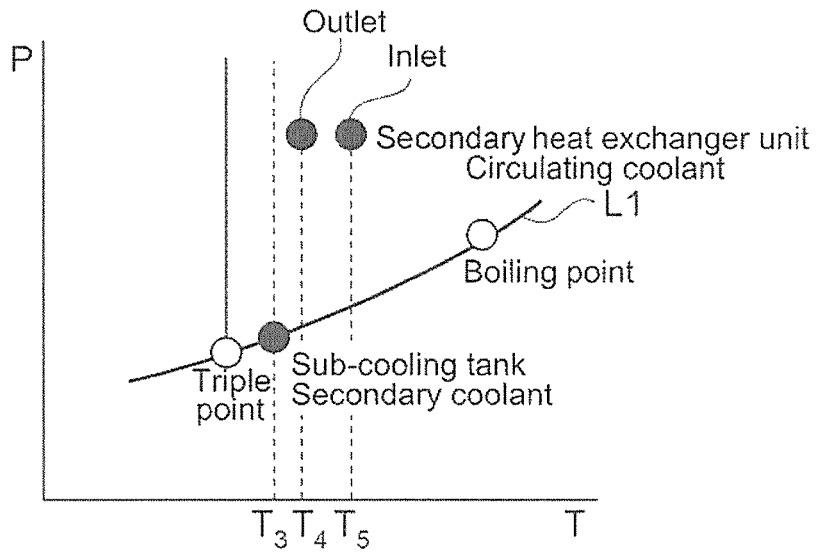
FIG. 4 is a graph illustrating an example of how pressure and temperature of the circulating coolant and the secondary coolant change while a depressurizing device is operating.

How the pressure and the temperature of the secondary coolant (liquid nitrogen) in the sub-cooling tank 30 and the circulating coolant (liquid nitrogen) circulating in the circulation path 7 change while the depressurizing device 35 is operating is described with reference to FIG. 4. In FIG. 4, the vertical axis represents the pressure and the horizontal axis represents the temperature. After the depressurizing device 35 is driven, the secondary coolant in the sub-cooling tank 30 is cooled, and thus the sub-cooling tank 30 has a lower temperature T3. Thus, a temperature T4 of the circulating coolant flowing out of the outlet of the secondary heat exchanger unit 31 is lower than a temperature T5 of the circulating coolant flowing into the inlet of the secondary heat exchanger unit 31, as a result of the heat exchange between the secondary coolant in the sub-cooling tank 30 and the circulating coolant flowing in the secondary heat exchanger unit 31.

As described above, as illustrated in FIG. 1, upon determining that the refrigerator 10 is faulty based on the information acquired from the refrigerator fault sensor 51, the control unit 50 controls the operation of the depressurizing device 35 so that the temperature of the secondary coolant, detected by the temperature sensor 32, becomes the predetermined temperature at which the secondary coolant is capable of cooling the superconducting cable 3 through the circulating coolant. Thus, the secondary coolant in the sub-cooling tank 30 is cooled. The cooled circulating coolant can be obtained through the heat exchange between the cooled secondary coolant and the circulating coolant flowing in the circulation path 7 via the secondary heat exchanger unit 31 in the sub-cooling tank 30, and is used to cool the superconducting cable 3. As a result, the temperature rise of the superconducting cable 3 can be prevented, and the conductivity of the superconducting cable 3 can be prevented from being compromised when the refrigerator 10 is faulty. Furthermore, when the refrigerator 10 is faulty, the coolant can be cooled only by using the sub-cooling tank 30, the secondary heat exchanger unit 31 in the sub-cooling tank 30, and the depressurizing device 35. Thus no extra refrigerator 10, including a turbo-compressor, a gas cooler, a regenerator, and a turbo-expander, needs to be prepared as a backup. Thus, the cooling apparatus 1 for a superconducting cable achieving both low cost and smaller installation space can be obtained.

[Second Embodiment]

Next, a cooling apparatus 60 for a superconductor according to a second embodiment will be described. In the second embodiment, only points different from the first embodiment are described, and portions that are the same as those in the first embodiment are denoted with the same reference numerals and the description thereof will be omitted. In the cooling apparatus 60 for a superconductor, the sub-cooling tank 30 includes the Brayton cycle heat exchanger unit 23 of the refrigerator 10. Thus, in a normal state with the refrigerator 10 not being faulty, the secondary coolant can be cooled through the heat exchange between the secondary coolant, stored in the sub-cooling tank 30 and gas in the refrigerator 10 via the Brayton cycle heat exchanger unit 23 disposed in the sub-cooling tank 30. Then, the cooled circulating coolant can be obtained through the heat exchange between the cooled secondary coolant and the circulating coolant flowing in the circulation path 7, via the secondary heat exchanger unit 31. Thus, the superconducting cable 3 can be cooled to a desired temperature.

Upon determining that the refrigerator 10 is faulty based on the information acquired from the refrigerator fault sensor 51, the control unit 50 controls the operation of the depressurizing device 35 so that the temperature of the secondary coolant, detected by the temperature sensor 32, becomes the predetermined temperature at which the secondary coolant is capable of cooling the superconducting cable 3 through the circulating coolant. Thus, the secondary coolant in the sub-cooling tank 30 is cooled. The cooled circulating coolant is obtained through the heat exchange between the cooled secondary coolant and the circulating coolant flowing in the circulation path 7 via the secondary heat exchanger unit 31 in the sub-cooling tank 30. The superconducting cable 3 is cooled by the cooled circulating coolant. As a result, the temperature rise of the superconducting cable 3 can be prevented, and the conductivity of the superconducting cable 3 can be prevented from being compromised when the refrigerator 10 is faulty. Unlike in the first embodiment described above, the heat exchanger unit 22 is not required, and thus the cooling apparatus 60 achieving an even lower cost can be obtained.

The superconductor, described as the superconducting cable 3 in the embodiments described above, may be any one of a superconducting motor, a superconducting current limiter, a superconducting transformer, and a superconducting magnetic energy storage (SMES).

REFERENCE SIGNS LIST

1 and 60 Cooling apparatus for superconductor
3 Superconducting cable (superconductor)
5 Circulation pump
6 Reservoir tank
7 Circulation path
10 Refrigerator
11 Turbo-compressor
13, 15, 17, and 19 Heat exchanger
21 Brayton heat exchanger unit (heat exchanger unit)
22 Heat exchanger unit
22*a* Cooling space
23 Brayton cycle heat exchanger unit
25 Turbo-expander
30 Sub-cooling tank
31 Secondary heat exchanger unit
32 Temperature sensor
35 Depressurizing device (depressurizing unit)
36 Suction path
40 Supply tank
41 Supply path
50 Control unit
51 Refrigerator fault sensor (defect detection unit)

What is claimed is:

1. A cooling apparatus for a superconductor, for cooling the superconductor with a circulation path formed by pumping a coolant, having been used for cooling the superconductor, by a circulation pump to a heat exchanger unit so that the coolant is cooled by a refrigerator, and then supplying the coolant to the superconductor, the cooling apparatus comprising:

a sub-cooling tank which is disposed on a downstream side of the superconductor and on an upstream side of the heat exchanger unit in the circulation path and which is configured to store a secondary coolant for cooling the coolant;

a secondary heat exchanger unit which is disposed in the sub-cooling tank and which is configured to cool the coolant, having been used for cooling the superconductor, through heat exchange with the secondary coolant stored in the sub-cooling tank;

a depressurizing unit configured to reduce pressure in the sub-cooling tank to cool the secondary coolant stored in the sub-cooling tank;

a temperature detection unit for detecting temperature of the secondary coolant stored in the sub-cooling tank;

a fault detection unit capable of detecting a fault state of the refrigerator; and a control unit configured to determine whether the refrigerator is faulty, based on information detected by the fault detection unit, and to control, upon determining that the refrigerator is faulty, an operation of the depressurizing unit so that the temperature of the secondary coolant, detected by the temperature detection unit, becomes a predetermined temperature at which the second coolant is capable of cooling the superconductor through the coolant.

2. A cooling apparatus for a superconductor, for cooling the superconductor with a circulation path formed by pumping a coolant, used for cooling the superconductor, by a circulation pump to a heat exchanger unit so that the coolant is cooled by a refrigerator, and then supplying the coolant to the superconductor, the cooling apparatus comprising:

a sub-cooling tank which is disposed in the circulation path and which is configured to store a secondary coolant used for cooing the coolant;

a secondary heat exchanger unit which is disposed in the sub-cooling tank and which is configured to cool the coolant, having been used for cooling the superconductor, through heat exchange with the secondary coolant stored in the sub-cooling tank;

a depressurizing unit configured to reduce pressure in the sub-cooling tank to cool the secondary coolant stored in the sub-cooling tank;

a temperature detection unit for detecting temperature of the secondary coolant stored in the sub-cooling tank;

a fault detection unit capable of detecting a fault state of the refrigerator; and a control unit configured to determine whether the refrigerator is faulty, based on information detected by the fault detection unit, and to control, upon determining that the refrigerator is faulty, an operation of the depressurizing unit so that the temperature of the secondary coolant, detected by the temperature detection unit, becomes a predetermined temperature at which the second coolant is capable of cooling the superconductor through the coolant, wherein the heat exchanger unit is disposed in the sub-cooling tank, and is configured to cool the secondary coolant, stored in the sub-cooling tank, through heat exchange with a refrigerator side coolant in the refrigerator, and the secondary heat exchanger unit is configured to exchange heat between the secondary coolant thus cooled and the coolant flowing in the circulation path to cool the coolant.

3. The cooling apparatus for a superconductor according to claim 1, further comprising a supply tank for storing the secondary coolant, wherein the supply tank is in communication with the depressurizing unit and the sub-cooling tank, and the secondary coolant stored in the supply tank is cooled by the depressurizing unit and supplied to the sub-cooling tank.

4. The cooling apparatus for a superconductor according to claim 2, further comprising a supply tank for storing the secondary coolant, wherein the supply tank is in communication with the depressurizing unit and the sub-cooling tank, and the secondary coolant stored in the supply tank is cooled by the depressurizing unit and supplied to the sub-cooling tank.

* * * * *